US005199357A

United States Patent [19]

Garcia-Mallol

[11] Patent Number: 5,199,357

[45] Date of Patent: Apr. 6, 1993

[54] FURNACE FIRING APPARATUS AND METHOD FOR BURNING LOW VOLATILE FUEL

[75] Inventor: Juan A. Garcia-Mallol, Morristown, N.J.

[73] Assignee: Foster Wheeler Energy Corporation, Clinton, N.J.

[21] Appl. No.: 673,918

[22] Filed: Mar. 25, 1991

[51] Int. Cl.[5] ..... F23D 1/00

[52] U.S. Cl. ..... 110/347; 110/244; 110/264; 110/265; 431/9

[58] Field of Search ..... 110/347, 244, 264, 265; 431/9

[56] References Cited

U.S. PATENT DOCUMENTS

| | | | |
|---|---|---|---|
| Re. 16,984 | 3/1924 | Leach . | |
| 1,661,408 | 3/1928 | Chapman . | |
| 2,707,444 | 9/1950 | Loon . | |
| 2,883,948 | 8/1952 | Seidl . | |
| 4,316,420 | 2/1982 | Kochey . | |
| 4,517,904 | 5/1985 | Penterson et al. | 110/264 |
| 4,810,186 | 3/1989 | Rennert et al. | 110/347 X |
| 4,902,221 | 2/1990 | Collins, Jr. et al. | 431/9 X |
| 5,020,454 | 6/1991 | Hellewell et al. | 110/264 |

OTHER PUBLICATIONS

Garcia-Mallol, J. A. and Kukoski, A. E.; Arch-Fired Furnace for Low-Volatile Fuels: Experience and Recent Development; presented at SEPRI Second Biannual Industrial Electric Power Application Symposium, New Orleans, La., Nov. 15-16, 1990.

*Primary Examiner*—Edward G. Favors
*Attorney, Agent, or Firm*—Marvin A. Naigur

[57] ABSTRACT

A furnace firing apparatus and method for burning low volatile fuel in which first and second burners are provided to introduce particulate, air-suspended fuel into primary and secondary combustion zones of a combustion chamber. The alignment of the second burner is adjustable and aligned so that the stream of fuel and air introduced by the second burner entrains combustion products produced by the burning of fuel in the primary combustion zone in order to ignite the fuel introduced by the second burner. Secondary air is provided by a pair of plenum chambers to support combustion of the fuel. In an alternate embodiment, an intermediate burner is provided to entrain combustion products from the combustion of fuel introduced by the first burner and whose combustion products are entrained into the fuel introduced by the second burner.

31 Claims, 2 Drawing Sheets

FURNACE FIRING APPARATUS AND METHOD FOR BURNING LOW VOLATILE FUEL

BACKGROUND OF THE INVENTION

The present invention relates to a furnace firing apparatus and method for burning pulverized fuel and, more particularly, to such an apparatus and method for use in large arch firing units or for use in burning low volatile fuel.

Over the years a wide variety of burner and furnace designs have been developed for handling and burning pulverized fuels. In a typical coal-fired furnace, pulverized coal, suspended in primary air, is delivered from a pulverizer, or mill, to the coal burners, or nozzles, and secondary air is provided to supply a sufficient amount of oxygen to support combustion. After initial ignition by a high energy arc igniter or small oil or gas conventional gun igniter, the subsequent incoming coal is ignited by recirculating a portion of the hot gases, generated from the combustion of previously introduced coal, into the incoming fuel stream.

Low volatile fuels, such as anthracite, antracite silt and petroleum coke, have less than one-third of the volatile matter of other fuels, and they require more time to ignite and longer time for complete, or near complete, combustion. The self-sustaining method as described above results in an inefficient method of burning low volatile fuels since a relatively large amount of the fuel will remain unconsumed, unless an arch unit is utilized. In an arch unit, this self-sustaining flame is produced by down-firing the coal into the furnace and introducing secondary air further down. This process can be enhanced by using conventional cyclone burners to introduce the fuel into the furnace with less suspension air.

To increase the percentage of low volatile fuel which can be consumed in arch fired furnaces, the length of the arch can be increased to subject the fuel to a longer burn time. However, there are physical and economical limits to a furnace's arch length. When these limits are reached, multiple arches are required. Lining a furnace with multiple arches, however, significantly increases the cost of both building and operating the furnace since each arch requires fuel and air inlets and initial ignition by conventional igniters.

SUMMARY OF THE INVENTION

It is therefore an object of the present invention to provide a new and improved furnace firing apparatus and method for burning low volatile fuels which increases the combustion efficiency over current designs.

It is a further object of the present invention to provide a new and improved furnace firing apparatus and method which reduces the cost of operating large furnaces which require multiple burners.

It is a still further object of the present invention to provide a new and improved furnace firing apparatus and method which increases the firing capacity of a furnace without penalizing its performance.

Toward the fulfillment of these and other objects, the furnace firing apparatus and method of the present invention provides both a primary row of burners and a secondary row of burners. The primary burners are aligned near the top of a combustion chamber in such a manner as to deliver fuel in a downward direction. The secondary burners are located below the primary burners and aligned to entrain a portion of the combustion products resulting from the combustion of the flow from the primary burners. Secondary air is provided by a pair of plenum chambers to support combustion of the fuel discharged from each burner. An intermediate row of burners, along with an associated plenum chamber, can be located between the primary and secondary rows of burners to result in even longer burn periods.

BRIEF DESCRIPTION OF THE DRAWING

The above brief description, as well as further objects, features and advantages of the present invention, will be more fully appreciated by reference to the following detailed description of presently preferred but nonetheless illustrated embodiments in accordance with the present invention when taken in conjunction with the accompanying drawings wherein.

DESCRIPTION OF THE PREFERRED EMBODIMENT

Figure 1:
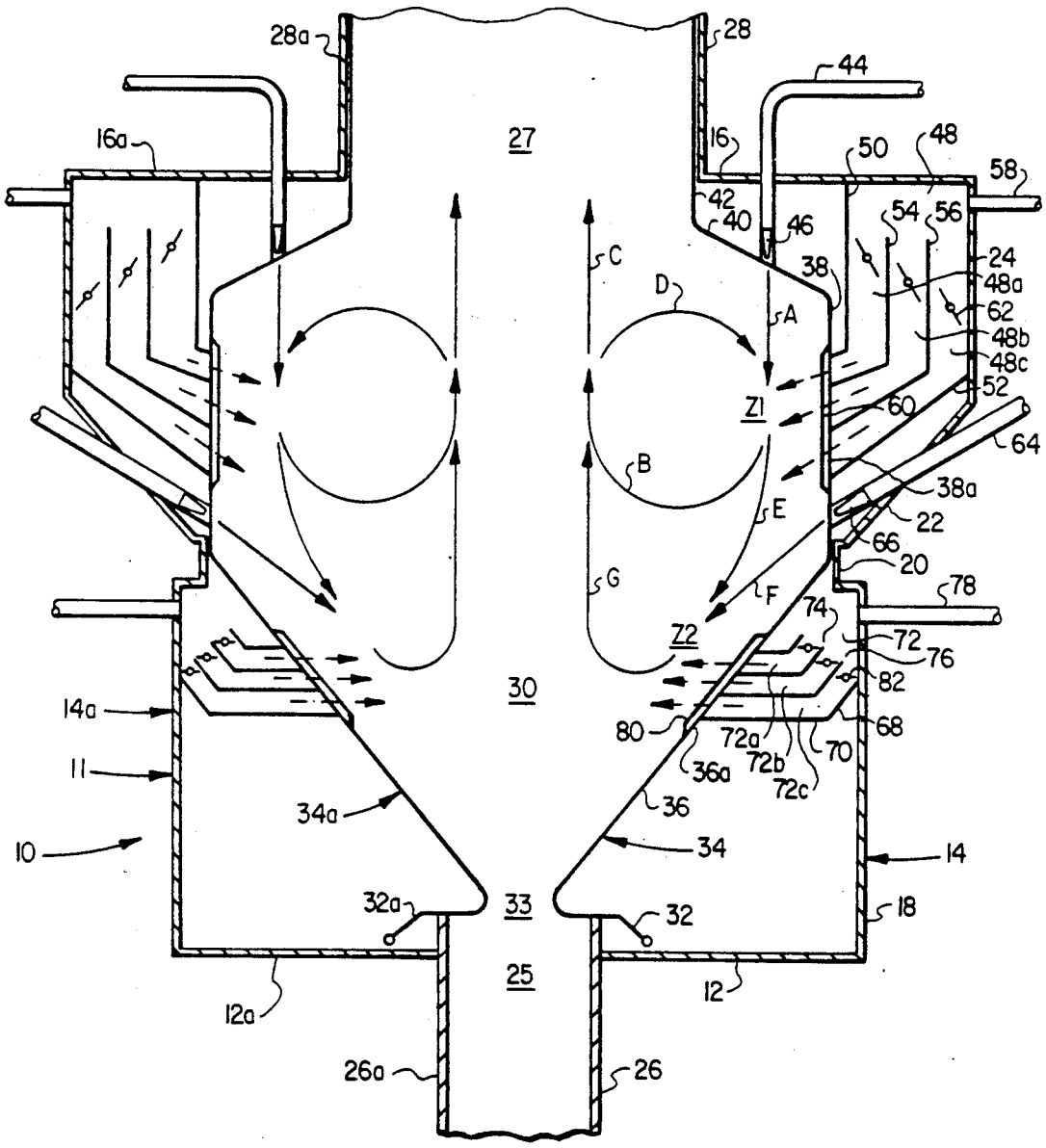
FIG. 1 is a cross-sectional view depicting the firing apparatus of the present invention.

Referring to the drawing, the reference numeral 10 refers in general to a standard furnace. The furnace has a housing 11 which is formed by base walls 12 and 12*a*, opposite side walls 14 and 14*a*, front and back walls (not shown) and arch top walls 16 and 16*a* which together form a continuous and integral structure. Although not shown in the drawing, it is understood that the walls 12, 12*a*, 14, 14*a*, 16 and 16*a* (and those not shown) include an appropriate thermal insulation material.

The left half of the furnace 10 as viewed in the drawing is formed by mirror images of all structures described on the right half, and therefore will not be described in detail.

The side wall 14 of the furnace housing 11 is formed by a lower vertical segment 18 extending upwardly from the base wall 12, an inwardly pinched-in segment 20 extending upwardly from the segment 18 at an intermediate level spaced above the base wall 12, an outwardly sloping segment 22 extending upwardly from the pinched in segment 20 and an upper vertical segment 24 extending upwardly from the outwardly sloping segment 2 to the arch top wall 16.

The base walls 12 and 12*a* of the furnace housing 11 do not meet but are instead divided by an opening 25 which extends along their entire length from the front wall to the back wall. Extending downwardly from the perimeter of the opening 25 are two vertical, spaced walls 26 and 26*a* which define a passage to an ash pit (not shown). Likewise, the two arch top walls 16 and 16*a* are spaced apart to define an opening 27 which extends along their entire length from the front wall to the back wall. Rising upwardly from the perimeter of the opening 27 are two vertical, spaced walls 28 and 28*a* which define a passage into an upper furnace (not shown).

A combustion chamber 30 is located within the furnace housing 11 and is defined by two base walls 32 and 32*a*, front and back walls (not shown) and opposite side walls 34 and 34*a* which together form a continuous and integral structure. The side wall 34 is formed by an outwardly sloping segment 36 extending upwardly from the base wall 32, a vertical segment 38 extending upwardly from the outwardly sloping segment 36, an inwardly sloping segment 40 extending upwardly from the vertical segment 38 and a vertical segment 42 extending upwardly from the inwardly sloping segment 40 and in a closely-spaced relation to the wall 28.

The walls 32, 32*a*, 34, 34*a* and the front and back walls which define the combustion chamber 30 are formed with boiler tubes through which a heat exchange fluid is circulated in a conventional manner.

As shown in the drawing, the upper end portions of the base walls 32 and 32*a* are spaced apart to define an opening 33 in alignment with the opening 25 to help define the passage to the ash pit (not shown).

A series of ducts 44 extend through aligned openings formed through the arch top wall 16 and the side wall segment 40. A primary burner 46 is mounted in the duct 44 and is aligned to deliver fuel, suspended in air commonly known as "primary air", in a generally downward direction into a primary combustion zone Z1 in the combustion chamber 30. The burner 46 is preferably of the type which bleeds off a portion of the primary air suspending the fuel before the fuel is delivered into the combustion chamber 30 to improve the burning of the fuel by reducing the amount of primary air in the primary combustion zone Z1. The cyclone burner is one such burner. Although not shown in the drawing for the convenience of presentation, it is understood that various conventional devices can be provided that produce ignition energy for a short period of time to ignite the fuel particles discharging from the primary burner 46.

An air plenum chamber 48 is defined between the side wall segments 38 and 24, the arch top wall 16, the back walls (not shown), a vertical wall 50 extending between and parallel to the wall segment 24 and the wall segment 42, and an angled wall 52 extending from the wall segment 24 to the wall segment 38. A pair of partitions 54 and 56 divide the plenum chamber 48 into three compartments 48*a*, 48*b* and 48*c*. An air inlet 58 extends through the side wall segment 24 and is in communication with the plenum chamber 48 for delivering air, commonly known as "secondary air", from an external source (not shown) to the chamber. A perforated air distribution plate 60 is provided covering an opening 38*a* in the side wall segment 38 for discharging pressurized air from the plenum chamber 48 and the opening 38*a* into the primary combustion zone Z1 of the combustion chamber 30 to support combustion of the fuel being discharged from the primary burner 46.

Air dampers 62 are provided in each of the plenum chamber compartments 48*a*, 48*b* and 48*c* for controlling the flow of secondary air through the compartments. The dampers 62 are suitably mounted in the compartments 48*a*, 48*b* and 48*c* for pivotal movement about their centers in response to actuation of external controls (not shown) to vary the effective openings of the compartments and thus control the flow of secondary air through the compartments. Since these dampers 62 are of a conventional design they will not be described in any further detail.

The flame and combustion gas flow pattern caused by the burning of fuel discharged from the primary burner 46 is depicted by the flow arrows in the drawing. The flame begins in a downward direction into the primary combustion zone Z1 as shown by flow arrow A due to the momentum of the fuel and air discharging from the primary burner 46. The flame, the hot combustion gases and any unspent fuel then turn and travel upwardly along the path generally depicted by flow arrow B due to the natural forces of convection and the impact of the combustion supporting air from the distribution plate 60. A majority of the combustion gases continue in this upward direction and rise to the upper regions of the furnace as depicted by flow arrow C where their heat can be productively utilized. However, a portion of the combustion gases and the unspent fuel are entrained into the jet flow of fuel and air being discharged from the primary burner 46 as portrayed by flow arrow D. The entrained combustion gases are hot enough to ignite the fuel discharging from the primary burner 46 thereby enabling both fuel discharging from the primary burner 46, as well as the entrained unspent fuel, to burn which eliminates the need for additional ignition energy from an ignition device after the initial start-up of the system.

The apparatus and method described thus far is generally known. According to the present invention, a series of ducts 64 extend through aligned openings formed through the side wall segments 22 and 38. A secondary burner 66 is mounted in the duct 64 and is aligned to deliver fuel, suspended in air, preferentially in a downward direction into a secondary combustion zone Z2 which extends in the combustion chamber 30 below the primary combustion zone Z1. The burner 66 is also preferably of the type which, like a cyclone burner, bleeds off a portion of the primary air suspending the fuel before the fuel is delivered into the combustion chamber 30. It is understood that the secondary burner 66 can either be fixed or adjustable to direct the fuel where needed for the purpose of entraining combustion gases and unspent fuel from the primary combustion zone Z1 as depicted by flow arrow E. These entrained combustion gases are hot enough to ignite the fuel discharging from the secondary burner 66 which eliminates the need for an ignition device associated with the secondary burner.

Two angled walls 68 and 70 extend between the wall segments 18 and 36 and define with the latter segments and front and back walls (not shown) an air plenum chamber 72. A pair of partitions 74 and 76 divide the plenum chamber 72 into three compartments 72*a*, 72*b* and 72*c*. An air inlet 78 extends through the side wall segment 18 and is in communication with the plenum chamber 72 for distributing secondary air from an external source (not shown) to the chamber. A perforated air distribution plate 80 is provided covering an opening 36*a* in the side wall segment 36 for discharging pressurized air from the plenum chamber 72 and the opening 36*a* into the secondary combustion zone Z2 of the combustion chamber 30 to support combustion of the fuel being discharged from the secondary burner 66.

Air dampers 82 are provided in each of the plenum chamber compartments 72*a*, 72*b* and 72*c* for controlling the flow of secondary air through the compartments. The dampers 82 are suitably mounted in the compartments 72*a*, 72*b* and 72*c* for pivotal movement about their centers in response to actuation of external controls (not shown) to vary the effective openings of the compartments and thus control the flow of secondary air through the compartments. Since these dampers 80 are of a conventional design they will not be described in any further detail.

In the preferred embodiment, the burning of the fuel discharged from the secondary burner 66 into the secondary combustion zone Z2 of the combustion chamber 30 creates a pattern composed of flame, combustion gases and unspent fuel as depicted by the flow arrows F and G. The flame begins in a downward direction as shown by flow arrow F due to the momentum of the fuel and air discharging from the secondary burner 66. The flame, the resulting combustion gases and any unspent fuel then turn and travel upwardly along the path generally depicted by flow arrow G due to the natural forces of convection and the impact of the combustion supporting air from the distribution plate 80. A majority of the combustion gases continue in this upward direction and rise to the upper regions of the furnace as depicted by flow arrow C, but a portion of the combustion gases and unspent fuel are entrained into the jet flow of fuel and air being discharged from the primary burner 46 as shown by flow arrow D.

In operation, fuel, suspended in air, is discharged into the primary combustion zone Z1 of the combustion chamber 30 via the primary burner 46. Initially, this fuel is ignited by a device such as a high-energy arch igniter or a small oil or gas conventional gun igniter (not shown). The resulting flame and combustion gases travel downwardly as shown by flow arrow A due to the momentum of the incoming jet of fuel. Combustion supporting air is delivered into the primary combustion zone Z1 from the plenum chamber 48 through the opening 38*a* in the side wall segment 38 and the distribution plate 60. The flow of the combustion supporting air is controlled by the air dampers 62 to match the slow burning characteristic of the low volatile fuel.

At this point, the path taken by the combustion products depends on whether the secondary air and fuel burner 66 is firing. If the secondary burner 66 is not firing, the furnace 10 of the present invention operates as those furnaces known in the art. Specifically, the flame, the combustion gases and any entrained unspent fuel from the primary combustion zone Z1 start to turn and travel upwardly as shown by flow arrow B due to the natural forces of convection and the impact of the combustion supporting air from the distribution plate 60. A majority of the combustion gases continue in this upward direction and rise to the upper regions of the furnace as depicted by flow arrow C where their heat can be productively utilized. A portion of the combustion gases and the unspent fuel are entrained into the jet flow of fuel and air being discharged from the primary burner 46 as shown by flow arrow D. The entrained combustion gases are hot enough to ignite the fuel discharging from the primary burner 46 thereby enabling both the fuel discharging from the primary burner 46, as well as the entrained unspent fuel, to burn which eliminates the need for additional ignition energy from an ignition device after the initial start-up of the system.

If the secondary burner 66 of the present invention is firing, a portion of the combustion gases and the unspent fuel from the primary combustion zone Z1 are entrained into the jet flow of fuel an air being discharged through the secondary burner 66 as depicted by flow arrow E, thereby providing a longer burn time for the unspent fuel. The entrained combustion gases are hot enough to ignite the fuel discharging from the secondary burner 66 thereby eliminating the need for any igniter apparatus whatsoever associated with this burner. If too little or too much of the combustion products from the primary combustion zone Z1 are being entrained into the jet flow of fuel and air being discharged from the secondary burner 66, the alignment of the secondary burner 66 can be altered to vary the amount of entrained combustion products.

The flame and combustion gases of the secondary combustion zone Z2 travel preferentially in a downward direction due to the momentum of the fuel and air discharging from the secondary burner 66. Combustion supporting air is delivered into the secondary combustion zone Z2 from the plenum chamber 72 through the opening 36*a* in the side wall segment 36 and the distribution plate 80. The flow of the combustion supporting air is controlled by the air dampers 82 to match the slow burning characteristic of the low volatile fuel.

The flame, the resulting combustion gases and the entrained unspent fuel then turn and travel upwardly as shown by flow arrow G due to the impact of the natural forces of convection and the incoming combustion supporting air from the plenum chamber 72. Most of the combustion gases continue to rise following the path of flow arrow C due to the forces of convection. A portion of the combustion gases and the unspent fuel, however, are entrained into the jet flow of fuel and air being discharged from the primary burner 46 as shown by flow arrow D.

The ash produced by the burning of the fuel falls through the aligned openings 25 and 3 and is deposited in the ash pit (not shown) via the passage formed by the walls 26 and 26*a*.

Several advantages result from the foregoing. For example, the passage of the entrained unspent fuel into the secondary combustion zone Z2 allows low volatile fuels such as anthracite or coke to be efficiently consumed due to their longer burn time. Further, in large furnaces, the use of both a primary burner and a secondary burner permits the burning of an amount of fuel in excess of what is achievable through the use of a single arch which is limited in size by both physical and economical limits. The present invention is also more economical than conventional multiple arch burners due to the entrainment of combustion gases from one combustion zone into another thereby eliminating the need for start-up igniters for each burner.

Figure 2:
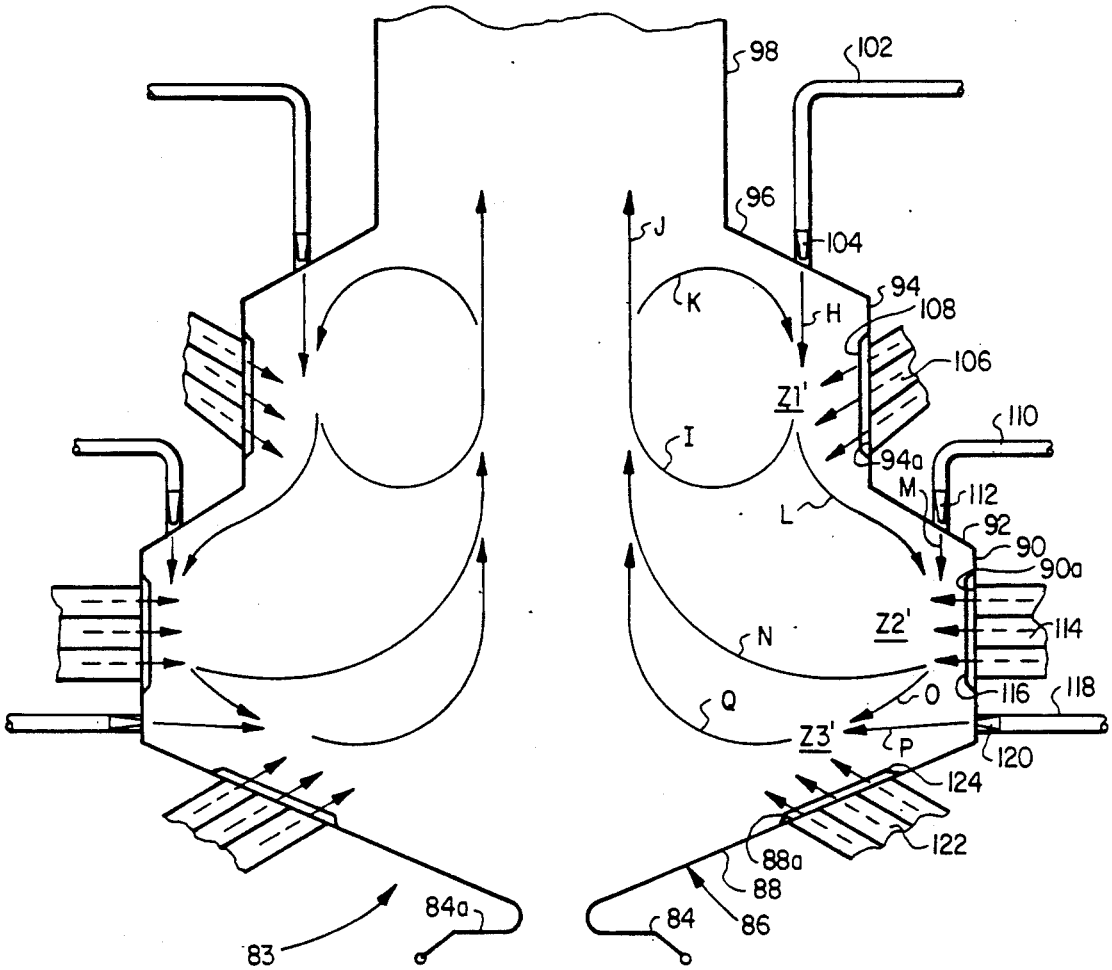
FIG. 2 is a cross-sectional view depicting an alternative embodiment of the present invention.

An alternative design of the present invention is shown in FIG. 2, in which the reference numeral 83 refers in general to a combustion chamber located within the furnace 10. The combustion chamber 83 is defined by two base walls 84 and 84*a*, front and back walls (not shown) and opposite side walls 86 and 86*a* which together form a continuous and integral structure. Since the left half of this embodiment is also formed by mirror images of all structures described on the right half, it will not be described in detail.

The side wall 86 is formed by an outwardly sloping segment 88 extending upwardly from the base wall 84, a vertical segment 90 extending upwardly from the outwardly sloping segment 88, an inwardly sloping segment 92 extending upwardly from the vertical segment 90, a vertical segment 94 extending upwardly from the inwardly sloping segment 92, an inwardly sloping segment 96 extending upwardly from the vertical segment 94 and a vertical segment 98 extending upwardly from the inwardly sloping segment 96. The walls 84, 86, 88, 90, 92, 94, 96 and 98 and the front and back walls which define the combustion chamber 83 are formed with boiler tubes through which a heat exchange fluid is circulated in a conventional manner.

A duct 102 extends through an opening formed to the side wall segment 96, and a primary burner 104 is mounted in the duct 102 in line to deliver fuel, suspended in primary air, in a generally downward direction into a primary combustion zone Z1' in the combustion chamber 83. Although not shown in the drawing for the convenience of presentation, it is understood that various conventional devices can be provided that produce ignition energy for a short period of time to ignite the fuel particles discharging from the primary burner 104.

A plenum chamber 106 delivers secondary air from an external source (not shown) to the combustion chamber 83 through a perforated air distribution plate 108 covering an opening 94*a* in the side wall segment 94 to support combustion of the fuel being discharged from the primary burner 104 into the primary combustion zone Z1'. Air dampers (not shown) are provided for controlling the flow of secondary air through the plenum 106 as previously described.

The flame and combustion gas flow pattern caused by the burning of fuel discharged from the primary burner 104 is identical to the pattern caused by the primary burner 46 and is depicted here in FIG. 2 by flow arrows H, I, J and K. As before, the entrained combustion gases shown by flow arrow K are hot enough to ignite the fuel discharging from the primary burner 104 thereby enabling both fuel discharging from the primary burner 104, as well as the entrained unspent fuel, to burn which eliminates the need for additional ignition energy from an ignition device after the initial start up of the system.

A duct 110 extends through an opening formed through the side wall segment 92 and contains a secondary burner 112 which is in line to deliver fuel, suspended in primary air, preferentially in a downward direction into a secondary combustion zone Z2' which extends in the combustion chamber 83 below the primary combustion zone Z1'. It is understood that the secondary burner 112 can either be fixed or adjustable to direct the fuel where needed for the purpose of entraining combustion gases and unspent fuel from the primary combustion zone Z1' as depicted by flow arrow L. These entrained combustion gases are hot enough to ignite the fuel discharging from the secondary burner 112 which eliminates the need for an ignition device associated with the secondary burner.

A plenum chamber 114 distributes secondary air from an external source (not shown) to the combustion chamber 83 through a perforated air distribution plate 116 covering an opening 90*a* in the side wall segment 90 to support combustion of the fuel being discharged from the secondary burner 112 into the secondary combustion zone Z2'. As earlier described, the flow of secondary air through the air plenum 114 can be controlled by air dampers (not shown).

In this embodiment, the burning of the fuel discharged from the secondary burner 112 into the secondary combustion zone Z2' of the combustion chamber 83 creates a pattern composed of flame, combustion gases and unspent fuel as depicted by flow arrows M and N. The flame begins in a downward direction as shown by flow arrow M due to the momentum of the fuel and air discharging from the secondary burner 112. The flame, the resulting combustion gases and any unspent fuel then turn and travel upwardly along the path generally depicted by flow arrow N due to the natural forces of convection and the impact of the combustion supporting air from the plenum 114. A majority of the combustion gases continue in this upward direction and rise to the upper regions of the furnace as depicted by flow arrow J. a portion of the combustion gases and unspent fuel are entrained in the jet flow of fuel and air being discharged from the primary burner 104 as shown by flow arrow K.

A third duct 118 extends through an opening in the side wall segment 90 and contains a tertiary burner 120 which is in line to delivery fuel, suspended in primary air, preferentially in a downward direction into a tertiary combustion zone Z3' which extends in the combustion chamber 83 below the secondary combustion zone Z2'. It is understood that the tertiary burner 120 can either be fixed or adjustable to direct the fuel where needed for the purpose of entraining combustion gases and unspent fuel from the secondary combustion zone Z2' as depicted by flow arrow O. these entrained combustion gases are hot enough to ignite the fuel discharging from the tertiary burner 120 which eliminates the need for an ignition device associated with the tertiary burner.

A plenum chamber 122 distributes secondary air from an external source (not shown) to the combustion chamber 83 through a perforated air distribution plate 124 covering an opening 88*a* in the side wall segment 88 to support combustion of the fuel being discharged from the tertiary burner 120 into the tertiary combustion zone Z3'.

The burning of the fuel discharged from the tertiary burner 120 in to the tertiary combustion zone Z3' creates a pattern composed of flame, combustion gases and unspent fuel as depicted by the flow arrows P and Q. The flame begins in a generally horizontal direction as shown by flow arrow P due to the momentum of the fuel and air discharging from the tertiary burner 120. The flame, the resulting combustion gases and any unspent fuel then turn and travel upwardly along the path generally depicted by flow arrow Q due to the natural forces of convection and the impact of the combustion supporting air from the plenum chamber 122. A majority of the combustion gases continue in this upward direction and rise to the upper regions of the furnace as depicted by flow arrow J, but a portion of the combustion gases and unspent fuel are entrained into the jet flow of fuel and air being discharged from the primary burner 104 as shown by flow arrow K.

The alternative design shown in FIG. 2 operates in the same manner as the previous embodiment. However, if the tertiary burner 120 of the present invention is firing, a portion of the combustion gases and the unspent fuel from the secondary combustion zone Z2' are entrained into the jet flow of fuel and air being discharged through the tertiary burner 120 as depicted by flow arrow O, thereby providing an even longer burn time for the unspent fuel. The entrained combustion gases are hot enough to ignite the fuel discharging from the tertiary burner 120 thereby eliminating the need for any igniter apparatus whatsoever associated with this burner. If too little or too much of the combustion products from the secondary combustion zone Z2' are being entrained into the jet flow of fuel and air being discharged from the tertiary burner 120, the alignment of the tertiary burner 120 can be altered to vary the amount of entrained combustion products.

The flame and combustion gases of the tertiary combustion zone Z3' travel preferentially in a generally horizontal direction due to the momentum of the fuel and air discharging from the tertiary burner 120. Combustion supporting air is delivered into the tertiary combustion zone Z3' from the plenum chamber 122 through the opening 88*a* in the side wall segment 88 and the distribution plate 124. The flow of the combustion supporting air is controlled by the air dampers (not shown) to match the slow-burning characteristic of the low volatile fuel.

The flame, the resulting combustion gases and the entrained unspent fuel then turn and travel upwardly as shown by flow arrow Q due the impact of the natural forces of convention and the incoming combustion supporting air from the plenum chamber 122. Most of the combustion gases continue to rise following the path of flow arrow J. A portion of the combustion gases and the unspent fuel, however, are entrained into the jet flow of fuel and air being discharged from the primary burner 104 as shown by flow arrow K.

Besides having the advantages of the previous embodiment, the embodiment shown in FIG. 2 results in even longer burn periods by entraining the unspent fuels into multiple combustion zones. Any number of a plurality of intermediate burners can be located such that they discharge into the combustion chamber to create multiple arches, each complete with its own combustion supporting air, to further lengthen the burn period.

It is understood that several variations may be made in the foregoing without departing from the scope of the present invention. For example, both the primary burner 46 and the secondary burner 66 can be conventional nozzles or cyclone burners. Further, a plurality of intermediate burners can be located between the primary burner and the secondary burner to create multiple arches, each complete with its own combustion supporting air, to result in even longer burn periods by entraining the unspent fuels into multiple combustion zones.

Other modifications, changes and substitutions are intended in the foregoing disclosure and although the invention has been described with reference to a specific embodiment, the foregoing description is not to be construed in a limiting sense. Various modifications to the disclosed embodiment as well as alternative applications of the invention will be suggested to persons skilled in the art by the foregoing specification and illustrations. Accordingly, it is appropriate that the appended claims be construed broadly and in a manner consistent with the true scope of the invention therein.

What is claimed is:

1. An apparatus for burning particulate fuel comprising:

means defining a chamber for combusting fuel;

a first discharge means extending into said combustion chamber for discharging a first stream of fuel into a primary combustion zone of said combustion chamber; and a second discharge means extending into said combustion chamber for discharging a second stream of fuel into a secondary combustion zone of said combustion chamber, said second discharge means being positioned such that said second stream of fuel entrains combustion products from said primary combustion zone and the position of said second discharge means being adjustable to vary the amount of said combustion products entrained into said second stream of fuel.

2. The apparatus of claim 1, further comprising means for introducing air into said primary and secondary combustion zones to support combustion of said fuel streams.

3. The apparatus of claim 2, wherein:

said combustion chamber has a pair of openings extending therethrough; and said introducing means comprises one or more plenum chambers registering with said combustion chamber to allow said combustion supporting air to flow through said openings into said combustion chamber.

4. The apparatus of claim 1, wherein said first and second discharge means comprises nozzles.

5. The apparatus of claim 1, wherein said first and second discharge means comprises burners for receiving said streams of fuel suspended in air and bleeding off a portion of said suspension air prior to discharging said streams into said combustion chamber.

6. An apparatus for burning particulate fuel comprising:

means defining a chamber for combusting fuel, said combustion chamber having a pair of openings extending therethrough;

a first burner for discharging a first stream of particulate, air-suspended fuel into a primary combustion zone of said combustion chamber;

a second burner for discharging a second stream of particulate, air-suspended fuel into a secondary combustion zone of said combustion chamber, said second burner being adjustable and aligned such that said second stream of fuel entrains combustion products from said primary combustion zone; and a pair of plenum chambers attached to said combustion chamber for introducing air into said primary and secondary combustion zones via said openings in said combustion chamber to support combustion of said fuel.

7. The apparatus of claim 6, wherein said burners comprise means for receiving said streams of particulate, air-suspended fuel and means for bleeding off a portion of said suspension air prior to discharging said streams into said combustion chamber.

8. An improved particulate fuel-burning apparatus of the type in which a stream of fuel is discharged into a primary combustion zone of a combustion chamber, wherein the improvement comprises:

discharge means extending into said combustion chamber for discharging a stream of fuel into a secondary combustion zone of said combustion chamber, said discharge means being positioned such that said stream of fuel discharged into said secondary combustion zone entrains combustion products from said primary combustion zone and being adjustable to vary the amount of said combustion products entrained into said stream of fuel discharged into said secondary combustion zone.

9. The apparatus of claim 8, further comprising means for introducing air into said primary and secondary combustion zones to support combustion of said fuel streams.

10. The apparatus of claim 9, wherein:

said combustion chamber has a pair of openings extending therethrough; and said introducing means comprises one or more plenum chambers registering with said combustion chamber to allow said combustion supporting air to flow through said openings into said combustion chamber.

11. The apparatus of claim 8, wherein said discharge means comprises nozzles.

12. The apparatus of claim 8, wherein said discharge means comprises burners for receiving said streams of fuel suspended in air and bleeding off a portion of said suspension air prior to discharging said streams into said combustion chamber.

13. A method of burning particulate fuel which is comprised of the steps of:

discharging a first stream of fuel into a primary combustion zone of a combustion chamber;

igniting said first stream of fuel;

discharging a second stream of fuel into a secondary combustion zone of said combustion chamber;

aligning said second stream of fuel so that said second stream of fuel entrains combustion products from said primary combustion zone; and controlling the amount of said combustion products which are entrained into said secondary combustion zone by adjusting the alignment of said second stream of fuel.

14. The method of claim 13, further comprising the step of introducing air into said primary and secondary combustion zones to support combustion of said fuel.

15. The method of claim 13, further comprising the steps of:

discharging a third stream of fuel into a tertiary combustion zone of said combustion chamber; and aligning said third stream of fuel so that said third stream of fuel entrains combustion products from said secondary combustion.

16. The method of claim 15, further comprising the step of introducing air into said primary, secondary and tertiary combustion zones to support combustion of said fuel.

17. The method of claim 15, further comprising the step of controlling the amount of said combustion products which are entrained into said tertiary combustion zone by adjusting the alignment of said third stream of fuel.

18. In a method of burning particulate fuel of the type wherein a stream of fuel is discharged into a primary combustion zone of a combustion chamber and ignited, the improvement comprising the steps of:

discharging a stream of fuel into a secondary combustion zone of said combustion chamber;

aligning said stream of fuel discharged into said secondary combustion zone so that said stream of fuel discharged into said secondary combustion zone entrains combustion products from said primary combustion zone; and controlling the amount of said combustion products which are entrained into said secondary combustion zone by adjusting the alignment of said stream of fuel discharged into said secondary combustion zone.

19. The method of claim 18, further comprising the step of introducing air into said primary and secondary combustion zones to support combustion of said fuel.

20. The method of claim 18, further comprising the steps of:

discharging a stream of fuel into a tertiary combustion zone of said combustion chamber;

aligning said stream of fuel discharged into said tertiary combustion zone so that said stream of fuel discharged into said tertiary combustion zone entrains combustion products from said secondary combustion zone.

21. The method of claim 20, further comprising the step of introducing air into said primary, secondary and tertiary combustion zones to support combustion of said fuel.

22. The method of claim 20, further comprising the step of controlling the amount of said combustion products which are entrained into said tertiary combustion zone by adjusting the alignment of said stream of fuel discharged into said tertiary combustion zone.

23. The apparatus of claim 1 further comprising a third discharge means extending into said combustion chamber for discharging a third stream of fuel into a tertiary combustion zone of said combustion chamber, said third discharge means being positioned such that said third stream of fuel entrains combustion products from said secondary combustion zone.

24. The apparatus of claim 23, wherein the alignment of said third discharge means is adjustable to vary the amount of said combustion products entrains into said third stream of fuel.

25. The apparatus of claim 23, further comprising means for introducing air into said tertiary combustion zone to support combustion of said third stream of fuel.

26. The apparatus of claim 23, wherein said third discharge means comprises a burner for receiving said third stream of fuel suspended in air and bleeding off a portion of said suspension air prior to discharging said third stream into said combustion chamber.

27. The apparatus of claim 6 further comprising:

a third burner for discharging a third stream of particulate, air-suspended fuel into a tertiary combustion zone of said combustion chamber, said third burner being adjustable and aligned such that said third stream of fuel entrains combustion products from said secondary combustion zone; and a third plenum chamber attached to said combustion chamber for introducing air into said tertiary combustion zone to support combustion of said fuel.

28. The apparatus of claim 27, wherein said third burner comprises means for receiving said third stream of particulate, air-suspended fuel and means for bleeding off a portion of said suspension air prior to discharging said third stream into said combustion chamber.

29. The apparatus of claim 8 further comprising an additional discharge means extending into said combustion chamber for discharging a stream of fuel into a tertiary combustion zone of said combustion chamber, said additional discharge means being positioned such that said stream of fuel discharged into said tertiary combustion zone entrains combustion products from said secondary combustion zone.

30. The apparatus of claim 27, wherein the alignment of said additional discharge means is adjustable to vary the amount of said combustion products entrained into said stream of fuel discharged into said tertiary combustion zone.

31. The apparatus of claim 29, further comprising means for introducing air into said tertiary combustion zone to support combustion of said stream of fuel discharged into said tertiary combustion zone.

* * * * *